US009889499B2

(12) United States Patent
Honda et al.

(10) Patent No.: US 9,889,499 B2
(45) Date of Patent: Feb. 13, 2018

(54) CONTINUOUS CASTING METHOD

(71) Applicant: NISSHIN STEEL CO., LTD., Tokyo (JP)

(72) Inventors: Yuuki Honda, Yamaguchi (JP); Hiroshi Morikawa, Yamaguchi (JP)

(73) Assignee: NISSHIN STEEL CO., LTD., Tokyo (JP)

( * ) Notice: Subject to any disclaimer, the term of this patent is extended or adjusted under 35 U.S.C. 154(b) by 0 days.

(21) Appl. No.: 14/914,118

(22) PCT Filed: Aug. 26, 2013

(86) PCT No.: PCT/JP2013/072721
§ 371 (c)(1),
(2) Date: Feb. 24, 2016

(87) PCT Pub. No.: WO2015/029106
PCT Pub. Date: Mar. 5, 2015

(65) Prior Publication Data

US 2016/0207101 A1 Jul. 21, 2016

(51) Int. Cl.
*B22D 11/106* (2006.01)
*B22D 11/111* (2006.01)
(Continued)

(52) U.S. Cl.
CPC ..... *B22D 11/002* (2013.01); *B22D 11/041* (2013.01); *B22D 11/106* (2013.01);
(Continued)

(58) Field of Classification Search
CPC ..... B22D 11/106; B22D 11/11; B22D 11/111; B22D 11/117
(Continued)

(56) References Cited

U.S. PATENT DOCUMENTS 5,429,655 A * 7/1995 Ogura ..... B22D 11/114 266/234
5,645,121 A * 7/1997 Barnes ..... B22D 41/08 164/415
(Continued)

FOREIGN PATENT DOCUMENTS

CN 101 992 280 A 3/2011
JP 57-184563 A 11/1982
(Continued)

OTHER PUBLICATIONS

EPO machine translation of JP 2012-061516, Mar. 29, 2012.*
(Continued)

*Primary Examiner* — Kevin E Yoon
(74) *Attorney, Agent, or Firm* — Rothwell, Figg, Ernst & Manbeck, P.C.

(57) ABSTRACT

In a continuous casting apparatus 100 for casting a stainless steel billet 3*c*, a long nozzle 2 extending into a tundish 101 is provided at a ladle 1 for pouring a molten stainless steel 3 in the ladle 1 into the tundish 101. Further, a nitrogen gas 4 is supplied as a seal gas around the molten stainless steel 3 in the tundish 101, and continuous casting of the stainless steel billet 3*c* is performed, in which, while immersing the spout 2*a* of the long nozzle 2 into the molten stainless steel 3 in the tundish 101, the molten stainless steel 3 is poured through the long nozzle 2 into the tundish 101 and the molten stainless steel 3 in the tundish 101 is poured into a casting mold 105.

5 Claims, 6 Drawing Sheets

(51) Int. Cl.

| | |
|---|---|
| ***B22D 11/00*** | (2006.01) |
| ***B22D 31/00*** | (2006.01) |
| ***B22D 11/11*** | (2006.01) |
| ***B22D 11/117*** | (2006.01) |
| ***B22D 11/041*** | (2006.01) |
| ***B22D 27/00*** | (2006.01) |

(52) U.S. Cl.
CPC ..... *B22D 11/11* (2013.01); *B22D 11/111* (2013.01); *B22D 11/117* (2013.01); *B22D 27/003* (2013.01); *B22D 31/002* (2013.01)

(58) Field of Classification Search
USPC ..... 164/459–491, 451–453
See application file for complete search history.

(56) References Cited

U.S. PATENT DOCUMENTS

| | | | | |
|---|---|---|---|---|
| 6,516,870 | B1 * | 2/2003 | Chakraborty | B22D 11/111 164/473 |
| 2005/0133192 | A1 * | 6/2005 | Meszaros | B22D 11/186 164/459 |
| 2010/0136363 | A1 * | 6/2010 | Valdez | B22D 11/111 428/586 |

FOREIGN PATENT DOCUMENTS

| | | | | |
|---|---|---|---|---|
| JP | 58116959 | A | * 7/1983 | |
| JP | 58212848 | A | * 12/1983 | B22D 11/10 |
| JP | 5-60648 | U | 8/1993 | |
| JP | 06-039505 | A | 2/1994 | |
| JP | 8-57599 | A | 3/1996 | |
| JP | 2001-286999 | A | 10/2001 | |
| JP | 2002-239692 | A | 8/2002 | |
| JP | 2012-61516 | A | 3/2012 | |
| JP | 2013-208641 | A | 10/2013 | |

OTHER PUBLICATIONS

Synthetic Slag, http://www.talvek.com/synthetic-slag-77.html, 2002.*

International Search Report issued in PCT Appln. No. PCT/JP2013/072721 dated Nov. 19, 2013, 2 pages.

Office Action issued in Japanese Patent Appln. No. 2012-080141 dated Feb. 1, 2016 along with English translation, 7 pages.

Extended European Search Report cited in 13892362.8-1362 dated Mar. 17, 2017, 7 pages.

* cited by examiner

CONTINUOUS CASTING METHOD

CROSS REFERENCE TO RELATED APPLICATIONS

This application is a 35 U.S.C. § 371 National Phase Entry Application from PCT/JP2013/072721, filed on Aug. 26, 2013, and designating the United States, which is incorporated herein by reference in its entirety.

TECHNICAL FIELD

This invention relates to a continuous casting method.

BACKGROUND ART

In the process for manufacturing stainless steel, which is a kind of metal, molten iron is produced by melting raw materials in an electric furnace, molten steel is obtained by subjecting the produced molten iron to refining including decarburization for instance performed to remove carbon, which degrades properties of the stainless steel, in a converter and a vacuum degassing device, and the molten steel is thereafter continuously cast to solidify to form a plate-shaped slab for instance. In the refining process, the final composition of the molten steel is adjusted.

In the continuous casting process, molten steel is poured from a ladle into a tundish and then poured from the tundish into a casting mold for continuous casting to cast. In this process, an inert gas which barely reacts with the molten steel is supplied as a seal gas around the molten steel transferred from the ladle to the casting mold to shield the molten steel surface from the atmosphere in order to prevent the molten steel with the finally adjusted composition from reacting with nitrogen and oxygen contained in the atmosphere, such reactions increasing the content of nitrogen and causing oxidation.

For example, PTL 1 discloses a method for manufacturing a continuously cast slab by using an argon gas as the inert gas.

CITATION LIST

Patent Literature

[PTL 1]
Japanese Patent Application Publication No. H4-284945

SUMMARY OF INVENTION

Technical Problem

However, the usage of the argon gas as the seal gas as in the manufacturing method of PTL 1 causes a problem. That is, the argon gas taken into the molten steel remains therein in the form of bubbles. As a result, bubble defects, that is, surface defects easily appear on the surface of the continuously cast slab due to the argon gas. Further, when such surface defects appear on the continuously cast slab, another problem appears. That is, the surface needs to be ground to ensure the required quality, increasing the cost.

The present invention has been created to resolve the above-described problems, and it is an objective of the invention to provide a continuous casting method in which an increase in nitrogen content during casting of a slab (solid metal) is suppressed and surface defects are reduced.

Solution to Problem

In order to resolve the above-described problems, the present invention provides a continuous casting method for casting a solid metal by pouring a molten metal in a ladle into a tundish disposed therebelow and continuously pouring the molten metal in the tundish into a casting mold, the continuous casting method including: supplying a nitrogen gas as a seal gas around the molten metal in the tundish; and pouring into the tundish the molten metal in the ladle through a pouring nozzle and pouring into the casting mold the molten metal in the tundish, while immersing a spout of the pouring nozzle, which serves for pouring the molten metal in the ladle into the tundish, into the molten metal in the tundish.

Advantageous Effects of Invention

With the continuous casting method in accordance with the present invention, it is possible to suppress an increase in nitrogen content and reduce surface defects when a solid metal is cast.

DESCRIPTION OF EMBODIMENTS

Embodiment 1

The continuous casting method according to Embodiment 1 of the invention will be explained hereinbelow with reference to the appended drawings. In the below-described embodiment, a method for continuously casting stainless steel is explained.

Stainless steel is manufactured by implementing a melting process, a primary refining process, a secondary refining process, and a casting process in the order of description.

In the melting process, scrap or alloys serving as starting materials for stainless steel production are melted in an electric furnace to produce molten iron, and the produced molten iron is transferred into a converter. In the primary refining process, crude decarburization is performed to remove carbon contained in the melt by blowing oxygen into the molten iron in the converter, thereby producing a molten stainless steel and a slag including carbon oxides and impurities. Further, in the primary refining process, the components of the molten stainless steel are analyzed and crude adjustment of components is implemented by charging alloys for bringing the steel composition close to the target composition. The molten stainless steel produced in the primary refining process is tapped into a ladle and transferred to the secondary refining process.

In the secondary refining process, the molten stainless steel is introduced, together with the ladle, into a vacuum degassing device, and finishing decarburization treatment is performed. A pure molten stainless steel is produced as a result of the finishing decarburization treatment of the molten stainless steel. Further, in the secondary refining process, the components of the molten stainless steel are analyzed and final adjustment of components is implemented by charging alloys for bringing the steel composition closer to the target composition.

Figure 1:
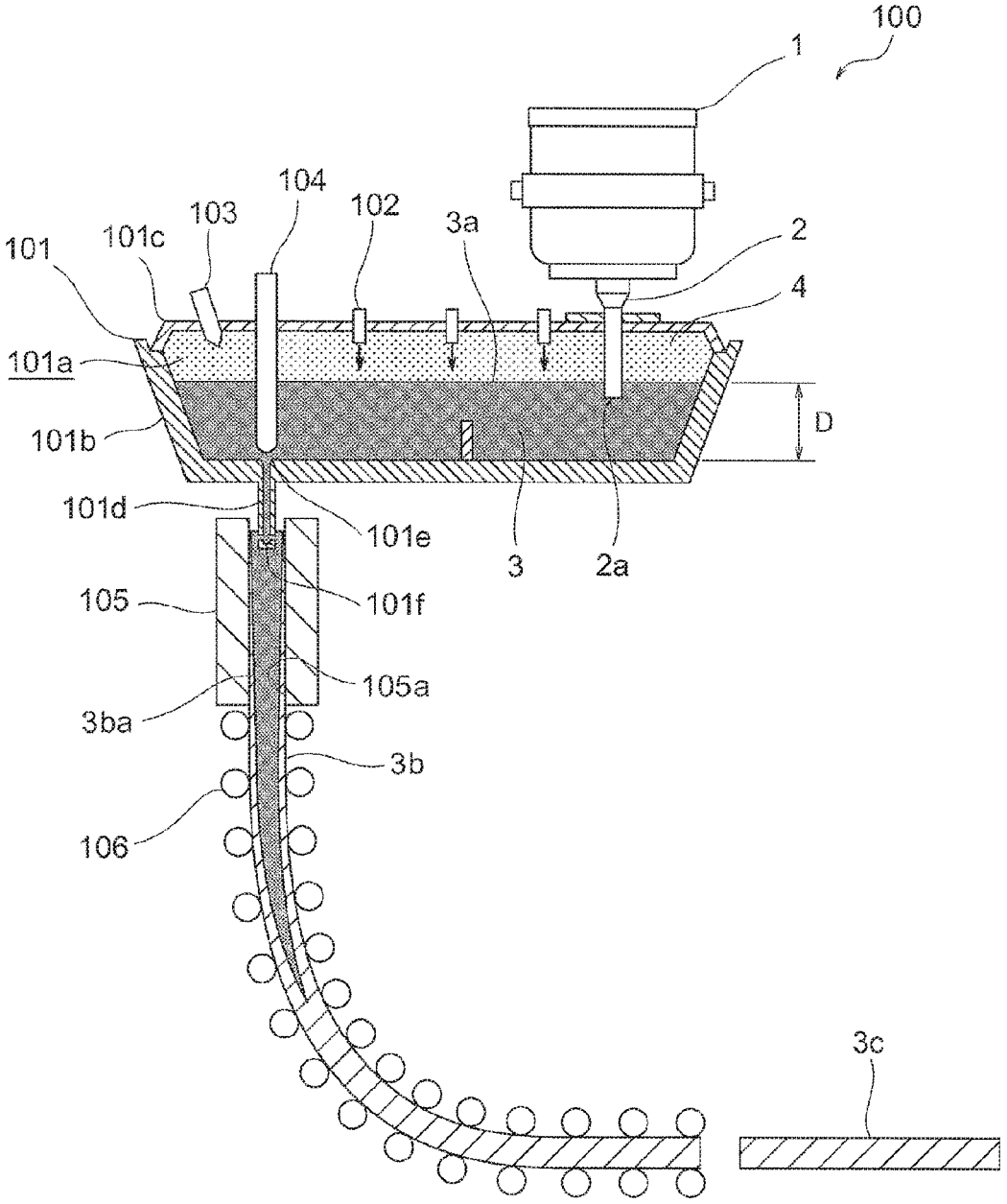
FIG. 1 is a schematic diagram illustrating the configuration of a continuous casting device which is used in the continuous casting method according to Embodiment 1 of the present invention.

In the casting process, as depicted in FIG. 1, the ladle 1 is taken out from the vacuum degassing device and set to a continuous casting device (CC) 100. Molten stainless steel 3 which is the molten metal in the ladle 1 is poured into the continuous casting device 100 and cast, for example, into a slab-shaped stainless steel billet 3*c* as a solid metal with a casting mold 105 provided in the continuous casting device 100. The cast stainless billet 3*c* is hot rolled or cold rolled in the subsequent rolling process (not illustrated in the figures) to obtain a hot-rolled steel strip or cold-rolled steel strip.

The configuration of the continuous casting device (CC) 100 will be explained hereinbelow in greater detail.

The continuous casting device 100 has a tundish 101 which is a container for temporarily receiving the molten stainless steel 3 transferred from the ladle 1 and transferring the molten stainless steel to the casting mold 105. The tundish 101 has a main body 101*b* which is open at the top, an upper lid 101*c* that closes the open top of the main body 101*b* and shields the main body from the outside, and an immersion nozzle 101*d* extending from the bottom of the main body 101*b*. In the tundish 101, a closed inner space 101*a* is formed by the main body 101*b* and the upper lid 101*c* inside thereof. The immersion nozzle 101*d* is opened into the interior 101*a* at the inlet port 101*e* from the bottom of the main body 101*b*.

Further, the ladle 1 is set above the tundish 101, and a long nozzle 2 is connected to the bottom of the ladle 1. The long nozzle 2 is a pouring nozzle for a tundish, which extends into the interior 101*a* through the upper lid 101*c* of the tundish 101. A spout 2*a* at the lower tip of the long nozzle 2 opens in the interior 101*a*. Sealing is performed and gas tightness is ensured between the through portion of the long nozzle 2 in the upper lid 101*c* and the upper lid 101*c*.

A plurality of gas supply nozzles 102 are provided in the upper lid 101*c* of the tundish 101. The gas supply nozzles 102 are connected to a gas supply source (not depicted in the figures) and deliver a predetermined gas from the top downward into the interior 101*a* of the tundish 101.

A powder nozzle 103 is provided in the upper lid 101*c* of the tundish 101, which is for charging a tundish powder (referred to hereinbelow as "TD powder") 5 (see FIG. 2) into the interior 101*a* of the tundish 101. The powder nozzle 103 is connected to a TD powder supply source (not depicted in the figure) and delivers the TD powder 5 from the top downward into the interior 101*a* of the tundish 101. The TD powder 5 is constituted by a synthetic slag agent, and the surface of the molten stainless steel 3 is covered thereby, the following effects for instance are produced on the molten stainless steel 3: the surface of the molten stainless steel 3 is prevented from oxidizing, the temperature of the molten stainless steel 3 is maintained, and inclusions contained in the molten stainless steel 3 are dissolved and absorbed. In Embodiment 1, the powder nozzle 103 and the TD powder 5 are not used.

A rod-shaped stopper 104 movable in the vertical direction is provided above the immersion nozzle 101*d*. The stopper 104 extends from the interior 101*a* of the tundish 101 to the outside through the upper lid 101*c* of the tundish 101.

Where the stopper 104 is moved downward, the tip thereof can close the inlet port 101*e* of the immersion nozzle 101*d*. Further, the stopper is also configured such that where the stopper is pulled upward from a position in which the inlet port 101*e* is closed, the molten stainless steel 3 inside the tundish 101 flows into the immersion nozzle 101*d* and the flow rate of the molten stainless steel 3 can be controlled by adjusting the opening area of the inlet port 101*e* according to the amount of pull-up. Further, sealing is performed and gas tightness is ensured between the through portion of the stopper 104 in the upper lid 101*c* and the upper lid 101*c*.

The tip 101*f* of the immersion nozzle 101*d* in the bottom portion of the tundish 101 extends into a through hole 105*a* of the casting mold 105, which is located therebelow, and opens sidewise.

The through hole 105*a* of the casting mold 105 has a rectangular cross section and passes through the casting mold 105 in the vertical direction. The through hole 105*a* is configured such that the inner wall surface thereof is water cooled by a primary cooling mechanism (not depicted in the figure). As a result, the molten stainless steel 3 inside is cooled and solidified and a slab 3*b* of a predetermined cross section is formed.

A plurality of rolls 106 for pulling downward and transferring the slab 3*b* formed by the casting mold 105 is provided apart from each other below the through hole 105*a* of the casting mold 105. A secondary cooling mechanism (not depicted in the figure) for cooling the slab 3*b* by spraying water is provided between the rolls 106.

The operation of the continuous casting device 100 will be explained hereinbelow.

Referring to FIG. 1, in the continuous casting device 100, the ladle 1 containing inside thereof the molten stainless steel 3 which has been secondarily refined is disposed above the tundish 101. Further, the long nozzle 2 is mounted on the bottom of the ladle 1, and the tip of the long nozzle having the spout 2*a* extends into the interior 101*a* of the tundish 101. In this configuration, the stopper 104 closes the inlet port 101*e* of the immersion nozzle 101*d*.

A valve (not depicted in the figure) which is provided at the long nozzle 2 is then opened, and the molten stainless steel 3 in the ladle 1 flows down under gravity inside the long nozzle 2 and then flows into the interior 101*a* of the tundish 101. Further, nitrogen ($N_2$) gas 4 which is soluble in the molten stainless steel 3 is injected from a gas supply nozzle 102 into the interior 101*a* of the tundish 101. As a result, air which includes impurities and exists in the interior 101*a* of the tundish 101 is pushed by the nitrogen gas 4 from the tundish 101 to the outside, and nitrogen gas 4 loaded into the interior 101*a* seals the surrounding of the molten stainless steel 3 and prevents it from coming into contact with another gas such as air.

The surface 3*a* of the molten stainless steel 3 in the interior 101*a* of the tundish 101 is raised by the inflowing molten stainless steel 3. Where the rising surface 3*a* causes the spout 2*a* of the long nozzle 2 to dip into the molten stainless steel 3 and the depth of the molten stainless steel 3 in the interior 101*a* of the tundish 101 becomes a predetermined depth D, the stopper 104 rises, the molten stainless steel 3 in the interior 101*a* flows into the through hole 105*a* of the casting mold 105 through the interior of the immersion nozzle 101*d*, and casting is started. At the same time, molten stainless steel 3 inside the ladle 1 is poured through the long nozzle 2 into the interior 101*a* of the tundish 101 and molten stainless steel 3 is supplied. When the molten stainless steel 3 in the interior 101*a* has the predetermined depth D, it is preferred that the long nozzle 2 penetrate into the molten stainless steel 3 such that the spout 2*a* is at a depth of about 100 mm to 150 mm from the surface 3*a* of the molten stainless steel 3. Where the long nozzle 2 penetrates to a depth larger than that indicated hereinabove, it is difficult for the molten stainless steel 3 to flow out from the spout 2*a* of the long nozzle 2 due to the resistance produced by the internal pressure of the molten stainless steel 3 remaining in the interior 101*a*. Meanwhile, where the long nozzle 2 penetrates to a depth less than that indicated hereinabove, when the surface 3*a* of the molten stainless steel 3, which is controlled such as to be maintained in the vicinity of a predetermined position during casting, changes and the spout 2*a* is exposed, the molten stainless steel 3 which has been poured out hits the surface 3*a* and nitrogen gas 4 can be dragged in the steel.

The molten stainless steel 3 which has flowed into the through hole 105*a* of the casting mold 105 is cooled by the primary cooling mechanism (not depicted in the figure) in the process of flowing through the through hole 105*a*, the steel on the inner wall surface side of the through hole 105*a* is solidified, and a solidified shell 3*ba* is formed. The formed solidified shell 3*ba* is pushed downward to the outside of the casting mold 105 by the solidified shell 3*ba* which is newly formed in an upper part of the through hole 105*a*. A mold powder is supplied from a tip 101*f* side of the immersion nozzle 101*d* to the inner wall surface of the through hole 105*a*. The mold powder acts to induce slag melting on the surface of the molten stainless steel 3, prevent the oxidation of the surface of the molten stainless steel 3 inside the through hole 105*a*, ensure lubrication between the casting mold 105 and the solidified shell 3*ba*, and maintain the temperature of the surface of the molten stainless steel 3 inside the through hole 105*a*.

The slab 3*b* is formed by the solidified shell 3*ba* which has been pushed out and the non-solidified molten stainless steel 3 inside thereof, and the slab 3*b* is grasped from both sides by rolls 106 and pulled further downward and out. In the process of being transferred between the rolls 106, the slab 3*b* which has been pulled out is cooled by water spraying with the secondary cooling mechanism (not depicted in the figure), and the molten stainless steel 3 inside thereof is completely solidified. As a result, by forming a new slab 3*b* inside the casting mold 105, while pulling out the slab 3*b* from the casting mold 105 with the rolls 106, it is possible to form the slab 3*b* which is continuous over the entire extension direction of the rolls 106 from the casting mold 105. The slab 3*b* is fed out to the outside of the rolls 106 from the end section of the rolls 106, and the fed-out slab 3*b* is cut to form a slab-shaped stainless billet 3*c*.

The casting rate at which the slab 3*b* is cast is controlled by adjusting the opening area of the inlet port 101*e* of the immersion nozzle 101*d* with the stopper 104. Furthermore, the inflow rate of the molten stainless steel 3 from the ladle 1 through the long nozzle 2 is adjusted such as to be equal to the outflow rate of the molten stainless steel 3 from the inlet port 101*e*. As a result, the surface 3*a* of the molten stainless steel 3 in the interior 101*a* of the tundish 101 is controlled such as to maintain a substantially constant position in the vertical direction in a state in which the depth of the molten stainless steel 3 remains close to the predetermined depth D. At this time, the spout 2*a* at the distal end of the long nozzle 2 is immersed in the molten stainless steel 3. Further, the casting state in which the vertical position of the surface 3*a* of the molten stainless steel 3 in the interior 101*a* is maintained substantially constant, while the spout 2*a* of the long nozzle 2 is immersed in the molten stainless steel 3 in the interior 101*a* of the tundish 101, as mentioned hereinabove, is called a stationary state.

Therefore, as long as the casting is performed in the stationary state, the molten stainless steel 3 flowing in from the long nozzle 2 does not hit the surface 3*a*, and therefore the nitrogen gas 4*b* is not dragged into the molten stainless steel 3 and the state of gentle contact of the molten stainless steel 3 with the surface 3*a* is maintained. As a result, although the nitrogen gas 4 is soluble in the molten stainless steel 3, the penetration thereof into the molten stainless steel 3 in the stationary state is suppressed.

Where no molten stainless steel 3 remains inside the ladle 1, the surface 3*a* of the molten stainless steel 3 in the interior 101*a* of the tundish 101 falls below the spout 2*a* of the long nozzle 2, but the surface is in contact with nitrogen gas 4 and is not disturbed, as when it is hit by the molten stainless steel 3 flowing down. Therefore, nitrogen gas 4 is prevented from admixing by dissolution to the molten stainless steel 3 till the end of the casting at which time no molten stainless steel 3 remains in the tundish 101.

Even before the spout 2*a* of the long nozzle 2 is immersed into the molten stainless steel 3 in the interior 101*a* of the tundish 101, the admixture of the air and nitrogen gas 4 caused by dragging into the molten stainless steel 3 is reduced because the distance between the spout 2*a* and the surface 3*a* of the molten stainless steel 3 on the bottom or in the interior 101*a* of the main body 101*b* of the tundish 101 is small, and also because the surface 3*a* is hit by molten stainless steel 3 only for a limited amount of time until the spout 2*a* is immersed.

Further, excluding the stainless steel billet 3*c* which is cast in the initial period of casting that is affected by a very small amount of air or nitrogen gas 4 mixed with the molten stainless steel 3 over a short period of time till the spout 2*a* of the long nozzle 2 is immersed into the molten stainless steel 3 in the interior 101*a* of the tundish 101, the stainless steel billet 3*c* cast over a period that takes most of the casting time from the start to the end of casting, this period being other than the abovementioned initial period of casting, is not affected by the abovementioned admixed air and nitrogen gas 4 and the admixture of the new nitrogen gas 4 is suppressed. Therefore, in the stainless steel billet 3*c* which is cast over most of the abovementioned casting time, the increase in the nitrogen content from that after the secondary refining is suppressed, and the occurrence of surface defects caused by bubbling which results from the dissolution of a small amount of admixed nitrogen gas 4 in the molten stainless steel 3 is greatly suppressed.

Therefore, by using nitrogen gas 4 as the seal gas in the stationary state of casting, it is possible to suppress the occurrence of bubbles in the stainless steel billet 3*c* after casting. Furthermore, the increase in the nitrogen content over that after the secondary refining can be suppressed by pouring the molten stainless steel 3 through the long nozzle 2 immersed by the spout 2*a* thereof into the molten stainless steel in the tundish 101.

Embodiment 2

In the continuous casting method according to Embodiment 2 of the invention, the TD powder 5 is sprayed to cover the surface 3*a* of the molten stainless steel 3 in the tundish 101 during casting in the continuous casting method according to Embodiment 1.

In the continuous casting method according to Embodiment 2, the continuous casting device 100 is used similarly to that in Embodiment 1. Therefore, the explanation of the configuration of the continuous casting device 100 is herein omitted.

Figure 2:
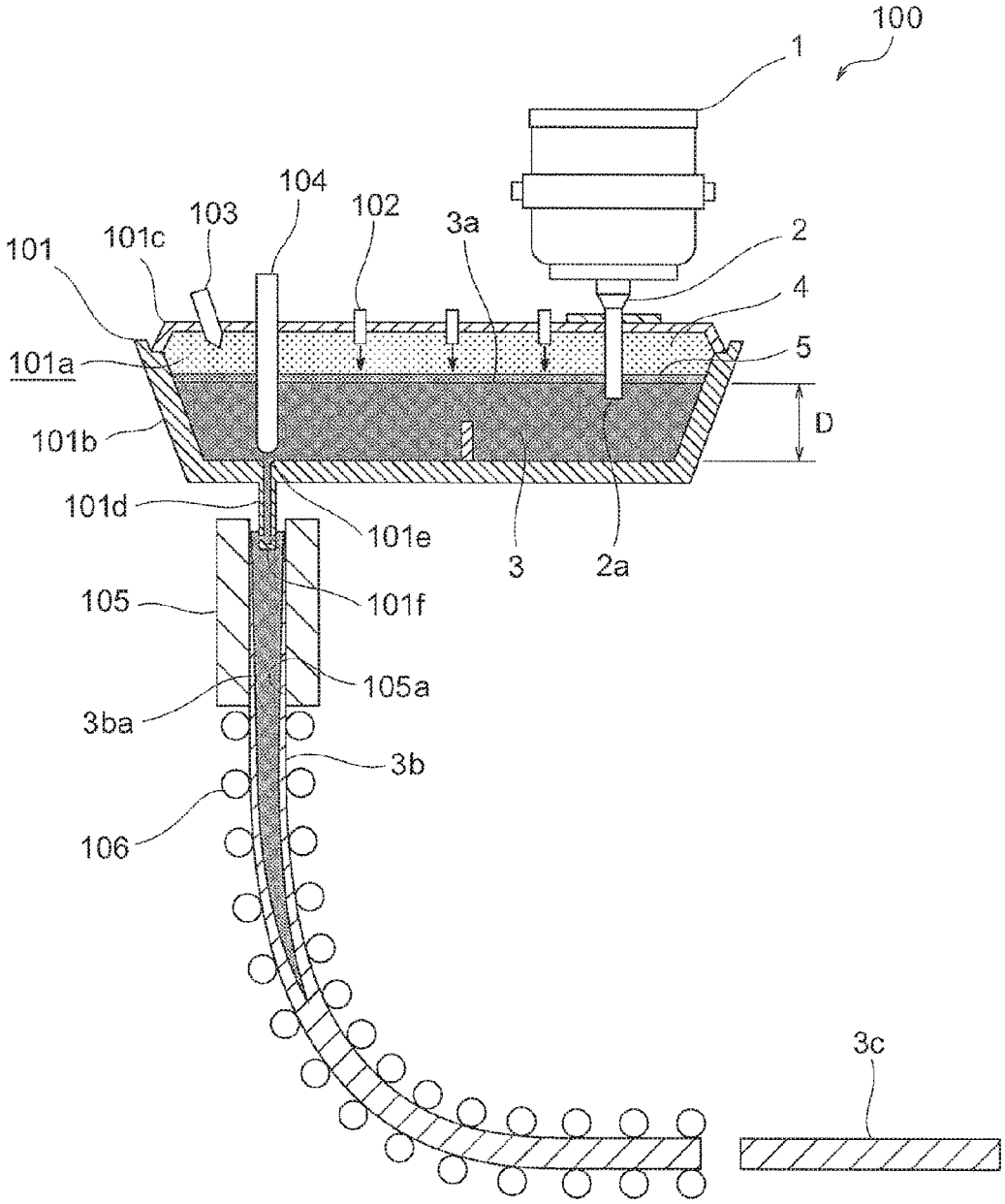
FIG. 2 is a schematic diagram illustrating a continuous casting apparatus during casting with the continuous casting method according to Embodiment 2 of the present invention.

The operation of the continuous casting apparatus 100 in Embodiment 2 will be explained with reference to FIG. 2.

In the continuous casting apparatus 100, in the tundish 101 in which the ladle 1 is set and the long nozzle 2 is mounted on the ladle 1, the molten stainless steel 3 is poured from the ladle 1 into the interior 101*a* of the tundish 101 through the long nozzle 2 in a state in which the inlet port 101*e* of the immersion nozzle 101*d* is closed by the stopper 104, in the same manner as in Embodiment 1. Further, nitrogen gas 4 is supplied from the gas supply nozzle 102 into the interior 101*a* of the tundish 101, and the interior is filled with the nitrogen gas 4.

Where the surface 3*a* of the molten stainless steel 3 rising because of the inflow of the molten stainless steel 3 becomes close to the spout 2*a* of the long nozzle 2 in the interior 101*a* of the tundish 101, the intensity at which the molten stainless steel 3 flowing down from the spout 2*a* hits the surface 3*a* decreases. Accordingly, the TD powder 5 is sprayed from the powder nozzle 103 toward the surface 3*a* of the molten stainless steel 3 in the interior 101*a*. The TD powder 5 is sprayed such as to cover the entire surface 3*a* of the molten stainless steel 3.

Further, where the surface 3*a* of the molten stainless steel 3 rises and the depth thereof becomes the predetermined depth D in the interior 101*a* of the tundish 101 into which the molten stainless steel 3 is poured, the stopper 104 is lifted. As a result, the molten stainless steel 3 in the interior 101*a* flows into the casting mold 105 and the casting is started.

During casting, in the tundish 101, the amount of molten stainless steel 3 flowing out from the immersion nozzle 101*d* and the amount of molten stainless steel 3 flowing in through the long nozzle 2 are adjusted such that the depth of the molten stainless steel 3 in the interior 101*a* is maintained close to the predetermined depth D and the surface 3*a* assumes a substantially constant position, while the spout 2*a* of the long nozzle 2 remains immersed in the molten stainless steel 3 in the interior 101*a* of the tundish 101.

As a result, at the surface 3*a* of the molten stainless steel 3 covered by the TD powder 5, the deposited TD powder 5 is prevented from being disturbed by the molten stainless steel 3 which is poured in, whereby the surface 3*a* is prevented from being exposed and coming into contact with the nitrogen gas 4. Therefore, the TD powder 5 continuously shields the surface 3*a* of the molten stainless steel 3 from the nitrogen gas 4 as long as the casting is performed in the stationary state.

Further, where no molten stainless steel 3 remains in the replacement ladle 1, the surface 3*a* of the molten stainless steel 3 in the interior 101*a* of the tundish 101 is lowered and comes below the spout 2*a* of the long nozzle 2. In this case, the TD powder 5 on the surface 3*a* of the molten stainless steel 3 fills the zone where the long nozzle 2 has become a through hole, and covers the entire surface 3*a*. Therefore, the TD powder 5 continuously prevents contact between the surface 3*a* of the molten stainless steel 3 and the nitrogen gas 4 till the end of casting when no molten stainless steel 3 remains in the tundish 101.

Therefore, in the tundish 101, the molten stainless steel 3 in the interior 101*a* is covered with the TD powder 5, and the molten stainless steel 3 in the ladle 1 is poured into the molten stainless steel 3 in the interior 101*a* through the long nozzle 2 which is immersed by the spout 2*a* thereof into the molten stainless steel 3 in the interior 101*a* in the stationary state of the casting after the TD powder 5 has been sprayed and until the subsequent end of the casting. As a result, the molten stainless steel 3 does not come into contact with the nitrogen gas 4, and the nitrogen gas 4 is practically not mixed with the molten stainless steel 3.

Further, excluding the stainless steel billet 3*c* which is cast in the initial period of casting that is affected by a very small amount of air or nitrogen gas 4 mixed with the molten stainless steel 3 over a short period of time before the TD powder 5 is sprayed, the stainless steel billet 3*c* cast over a period that takes most of the casting time from the start to the end of casting, this period being other than the above-mentioned initial period of casting, is not affected by the air and nitrogen gas 4 admixed before the TD powder 5 is sprayed, and practically no new nitrogen gas 4 is admixed. Therefore, in the stainless steel billet 3*c* which is cast over most of the abovementioned casting time, the nitrogen content practically does not increase from that after the secondary refining, and the occurrence of surface defects caused by bubbling of the admixed gas such as the nitrogen gas 4 is greatly suppressed.

Further, other features and operations relating to the continuous casting method according to Embodiment 2 of the invention are the same as in Embodiment 1, and the explanation thereof is, therefore, omitted.

EXAMPLES

Explained hereinbelow are examples in which stainless steel billets were cast by using the continuous casting methods according to Embodiments 1 and 2.

The evaluation of properties was performed with respect to Examples 1 to 4 in which slabs, which are stainless steel billets, were cast by using the continuous casting methods of Embodiments 1 and 2 with respect to SUS430, a ferritic single-phase stainless steel (chemical composition (19Cr-0.5Cu—Nb-LCN)), and SUS316L, and Comparative Examples 1 and 2 in which slabs of stainless steel SUS430 were cast by using a short nozzle as a pouring nozzle and argon gas or nitrogen gas as a seal gas. The detection results described hereinbelow were obtained by sampling from the slabs cast in the stationary state, excluding the initial period of casting, in the examples, and by sampling from the slabs cast within the same period as the sampling period of the examples from the beginning of casting in the comparative examples.

Table 1 shows the steel grades, types and supply flow rates of the seal gas, types of pouring nozzles, and whether or not a TD powder was used with respect to the examples and comparative examples. The short nozzle, as referred to in Table 1, has a length such that when the short nozzle is mounted instead of the long nozzle 2 on the ladle 1 in the configuration depicted in FIG. 1, the distal end at the lower side thereof is at an approximately the same height as the lower surface of the upper lid 101*c* of the tundish 101.

TABLE 1

| | Steel grade | Seal gas Type | Seal gas Supply flow rate | Type of pouring nozzle | TD powder |
|---|---|---|---|---|---|
| Example 1 | SUS430 | $N_2$ | 100 $Nm^3/h$ | Long nozzle | Not used |
| Example 2 | SUS430 | $N_2$ | 100 $Nm^3/h$ | Long nozzle | Used |
| Example 3 | Ferritic single-phase stainless steel | $N_2$ | 100 $Nm^3/h$ | Long nozzle | Used |
| Example 4 | SUS316L | $N_2$ | 100 $Nm^3/h$ | Long nozzle | Used |
| Comparative Example 1 | SUS430 | Ar | 100 $Nm^3/h$ | Short nozzle | Not used |
| Comparative Example 2 | SUS430 | $N_2$ | 100 $Nm^3/h$ | Short nozzle | Not used |

In Example 1, a stainless steel slab of SUS430 was cast using the continuous casting method of Embodiment 1.

In Example 2, a stainless steel slab of SUS430 was cast using the continuous casting method of Embodiment 2.

In Example 3, a stainless steel slab of a ferritic single-phase stainless steel (chemical composition (19Cr-0.5Cu—Nb-LCN)), which is a low-nitrogen steel, was cast using the continuous casting method of Embodiment 2.

In Example 4, a stainless steel slab of SUS316L (austenitic low-nitrogen steel), which is a low-nitrogen steel, was cast using the continuous casting method of Embodiment 2.

In Comparative Example 1, a stainless steel slab of SUS430 was cast using the short nozzle instead of the long nozzle 2 and using an argon (Ar) gas instead of the nitrogen gas as the seal gas in the continuous casting method of Embodiment 1.

In Comparative Example 2, a stainless steel slab of SUS430 was cast using the short nozzle instead of the long nozzle 2 in the continuous casting method of Embodiment 1.

Figure 6:
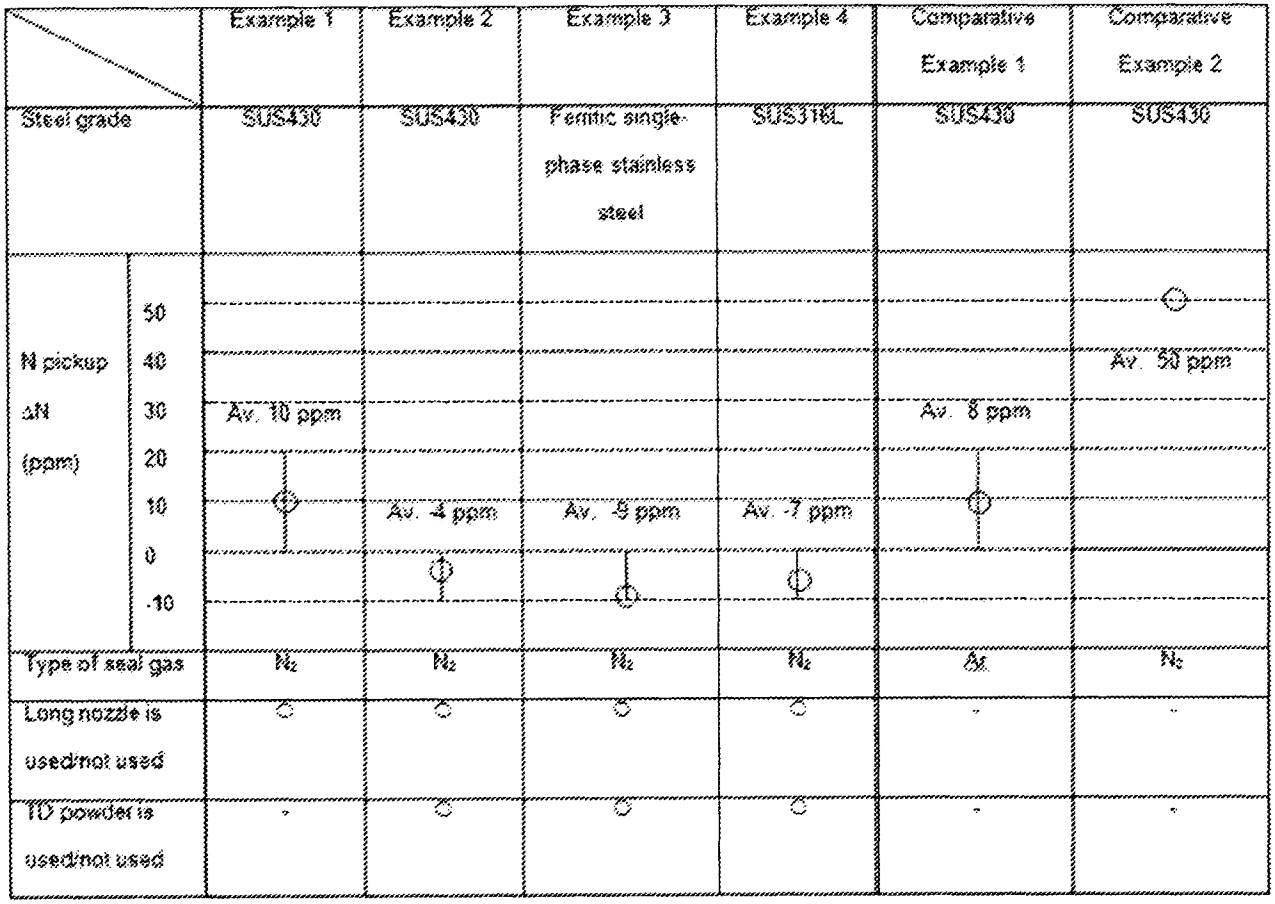
FIG. 6 is a table showing the results relating to an N pickup, which is the pickup amount of nitrogen (N), in the slabs cast in Examples 1 to 4 and Comparative Examples 1 and 2.

FIG. 6 shows the results relating to an N pickup, which is the pickup amount of nitrogen (N) in the slabs cast in Examples 1 to 4 and Comparative Examples 1 and 2. The N pickups measured in a plurality of slabs cast in Examples 1 to 4 and Comparative Examples 1 and 2 are summarized in FIG. 6. The N pickup is the increase in the nitrogen component contained in the cast slab with respect to the nitrogen component in the molten stainless steel 3 in the ladle 1 after the final adjustment of composition in the secondary refining process, this increase being the mass of the nitrogen component newly introduced in the molten stainless steel in the casting process. The N pickup is represented as a mass concentration in ppm units.

In Comparative Example 1, argon gas, rather than nitrogen gas, was used as the seal gas. As a result, the N pickup was within a range of 0 ppm to 20 ppm, and the average value thereof was as low as 8 ppm.

In Comparative Example 2, the short nozzle was used. As a result, the molten stainless steel poured into the tundish 101 hit the surface of the molten stainless steel in the tundish 101 and a large amount of the surrounding nitrogen gas was dragged in. As a consequence, the N pickup was 50 ppm, and the average value thereof also rose to 50 ppm.

In Example 1, the spout 2*a* of the long nozzle 2 was immersed in the stainless steel in the stationary state of casting. As a result, the molten stainless steel which was poured in was prevented from hitting the surface of the molten stainless steel in the tundish 101 and the nitrogen gas was in contact only with the smooth surface of the molten stainless steel. Therefore, the N pickup decreased to about the same level as in Comparative Example 1. More specifically, the N pickup in Example 1 was within a range of 0 ppm to 20 ppm, and the average value thereof was as low as 10 ppm.

In Examples 2 to 4, in addition to using the long nozzle 2, the molten stainless steel in the tundish 101 was shielded from the nitrogen gas by the TD powder in the stationary state of casting. For this reason, the N pickup was substantially lower than in Comparative Example 1 and Example 1. More specifically, the N pickup in Example 2 was within a range of −10 ppm to 0 ppm, and the average value thereof was very low and equal to −4 ppm. In other words, the content of nitrogen in the slab was lower than that in the molten stainless steel after the secondary refining. This is apparently because the TD powder had absorbed the nitrogen component contained in the molten stainless steel. The N pickup in Example 3 was also within a range of −10 ppm to 0 ppm, and the average value thereof was very low and equal to −9 ppm. Further, the N pickup in Example 4 was also within a range of −10 ppm to 0 ppm, and the average value thereof was very low and equal to −7 ppm.

Where argon gas, which is an inert gas, is contained in the molten stainless steel, it mostly remains as bubbles in the cast slab, without dissolving in the molten stainless steel, but nitrogen which is soluble in the molten stainless steel mostly dissolves in the molten stainless steel. Therefore, in the examples in which nitrogen gas was used as the seal gas, practically no nitrogen gas was detected as bubbles in the slab. In other words, in Examples 1 to 4 and Comparative Example 2, practically no bubbles were confirmed to be present in the slabs, whereas in Comparative Example 1, a large number of bubbles were confirmed to be present as surface defects in the slab.

Figure 3:
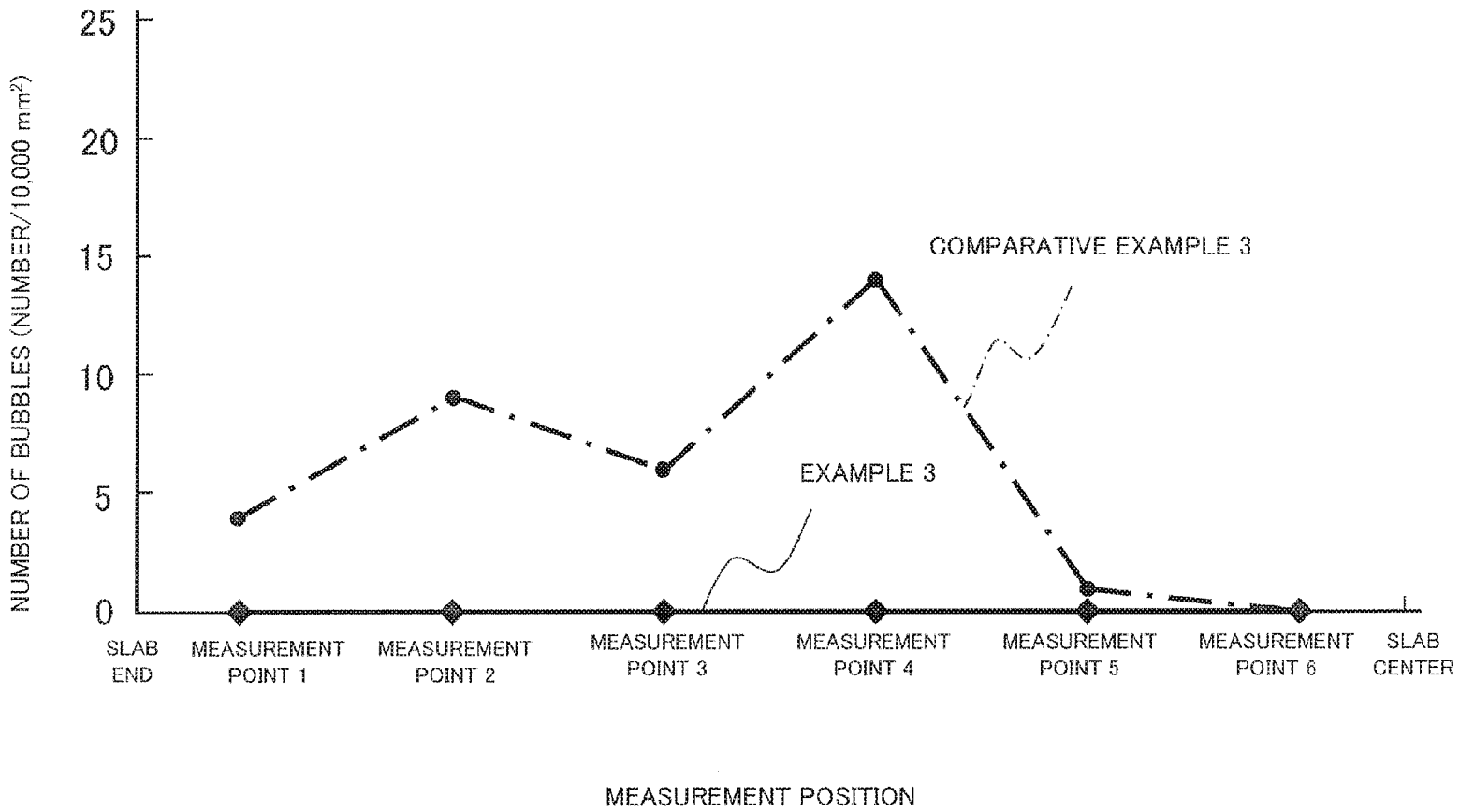
FIG. 3 illustrates a comparison of the number of bubbles generated in the stainless steel billet in Example 3 and Comparative Example 3.

For example, in FIG. 3, the number of bubbles with a diameter of 0.4 mm or more which appeared in the slabs was compared between Example 3 and Comparative Example 3 (steel grade: ferritic single-phase stainless steel [chemical composition: 19Cr-0.5Cu—Nb-LCN], seal gas: Ar, seal gas supply flow rate: 60 $Nm^3/h$, pouring nozzle: short nozzle). Depicted in FIG. 3 are the numbers of bubbles per 10,000 $mm^2$ (a 100 mm×100 mm region) at 6 measurement points obtained by dividing a region from the center to the end in the width direction of the slab surface into equal segments, the division being made from the center toward the end.

As depicted in FIG. 3, in Example 3, the number of bubbles was 0 over the entire region, and in Comparative Example 3, the bubbles were confirmed to be present over substantially the entire region, with 0 to 14 bubbles being confirmed at each measurement point.

Figure 4:
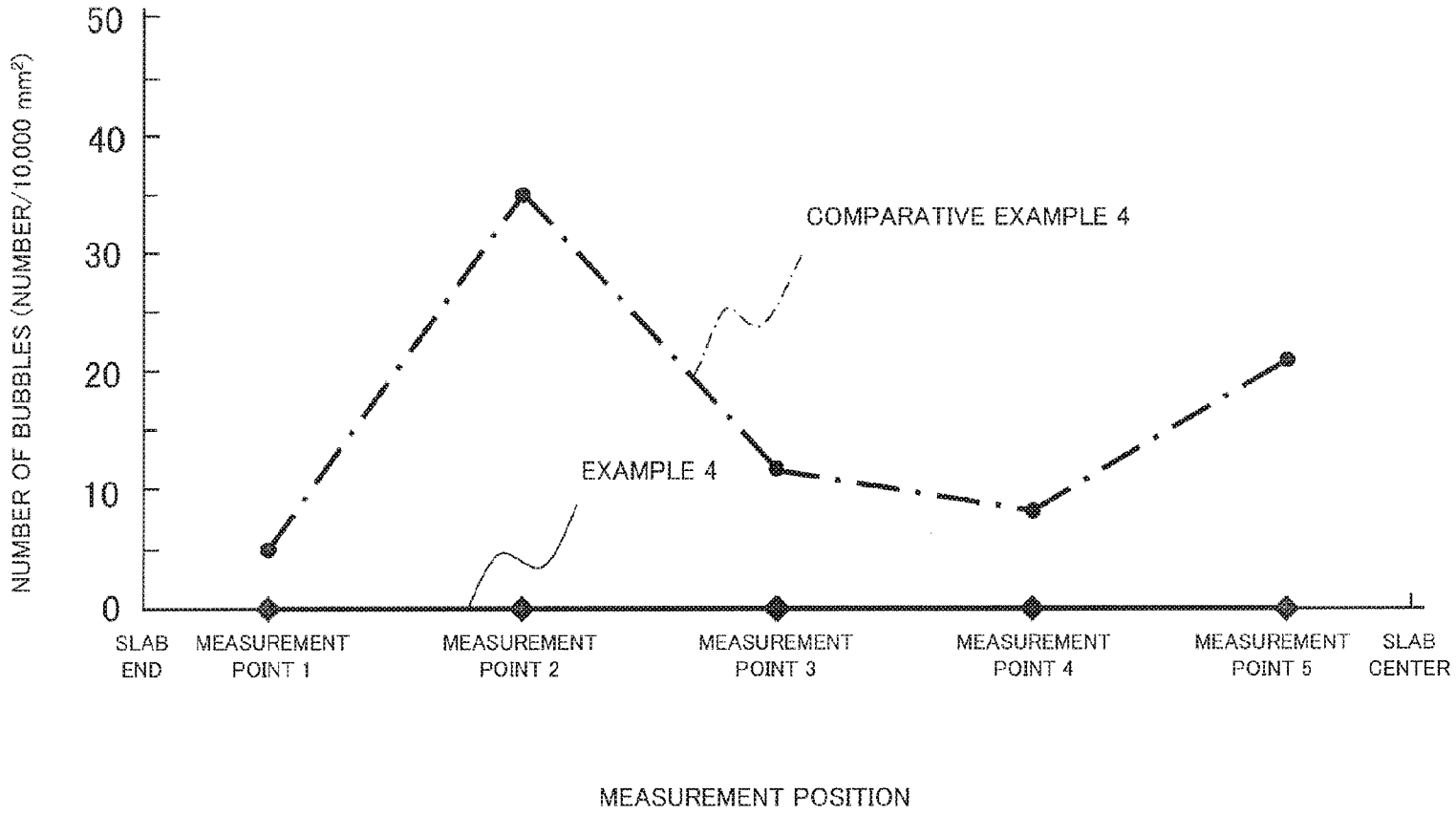
FIG. 4 illustrates a comparison of the number of bubbles generated in the stainless steel billet in Example 4 and Comparative Example 4.

Further, in FIG. 4, the number of bubbles with a diameter of 0.4 mm or more which appeared in the slabs was compared between Example 4 and Comparative Example 4 (steel grade: SUS316L (austenitic low-nitrogen steel), seal gas: Ar, seal gas supply flow rate: 60 $Nm^3/h$, pouring nozzle: short nozzle). Depicted in FIG. 4 are the numbers of bubbles per 10,000 $mm^2$ (a 100 mm×100 mm region) at 5 measurement points obtained by dividing a region from the center to the end in the width direction of the slab surface into equal segments, the division being made from the center toward the end.

As depicted in FIG. 4, in Example 4, the number of bubbles was 0 over the entire region, and in Comparative Example 4, the bubbles were confirmed to be present over substantially the entire region, with 5 to 35 bubbles being confirmed at each measurement point.

Figure 5:
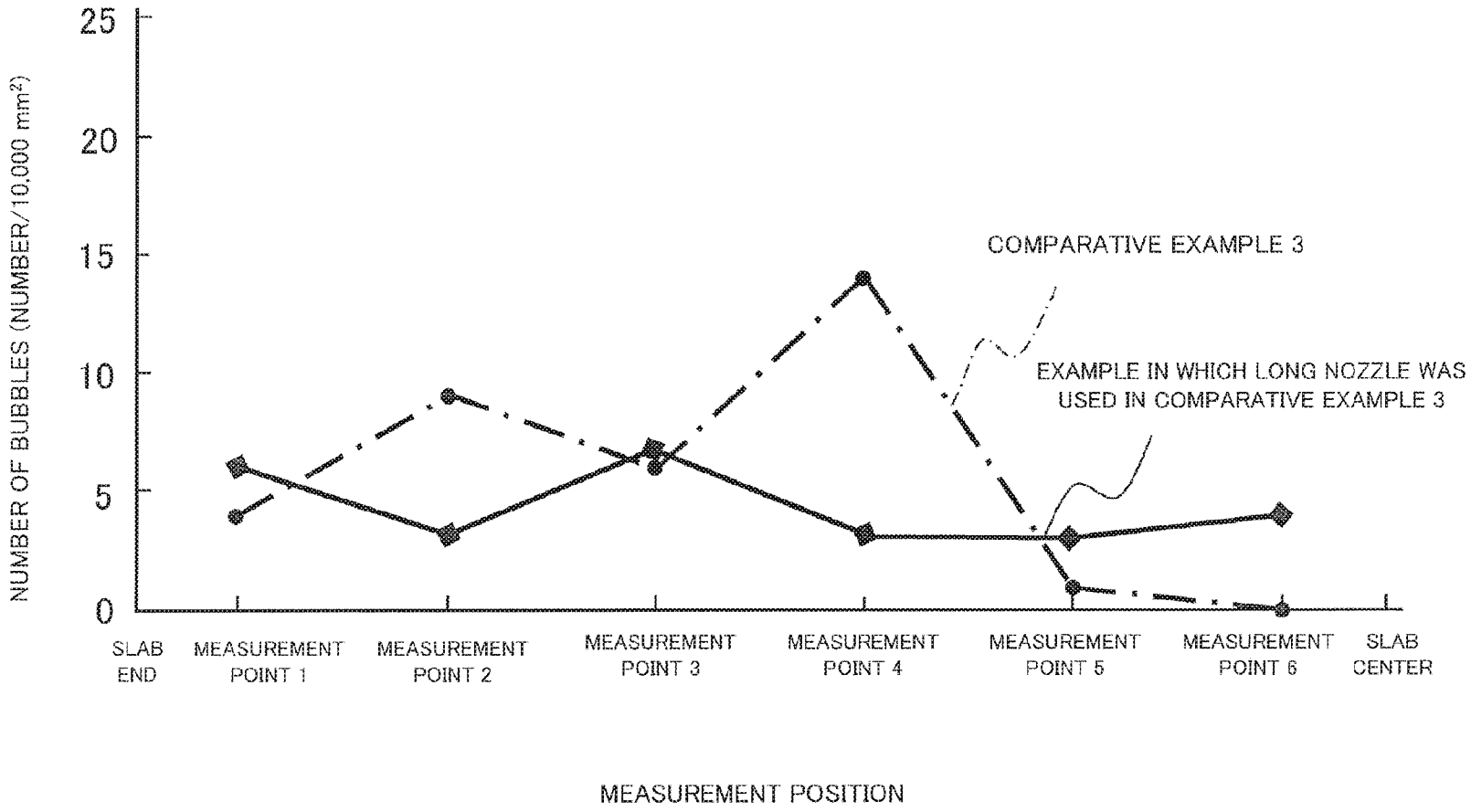
FIG. 5 illustrates a comparison of the number of bubbles generated in the stainless steel billet in Comparative Example 3 and when a long nozzle is used in Comparative Example 3.

Incidentally, in FIG. 5, the number of bubbles with a diameter of 0.4 mm or more which appeared in the slab in the aforementioned Comparative Example 3 is compared with the number of bubbles with a diameter of 0.4 mm or more which appeared in the slab cast in the stationary state, with the exception of the initial period, when the long nozzle 2 was used instead of the short nozzle in Comparative Example 3. Depicted in FIG. 5 are the numbers of bubbles per 10,000 $mm^2$ (a 100 mm×100 mm region) at 6 measurement points obtained by dividing a region from the center to the end in the width direction of the slab surface into equal segments, the division being made from the center toward the end.

As depicted in FIG. 5, when the long nozzle 2 was used, the number of bubbles decreased with respect to that in Comparative Example 3, but 3 to 7 bubbles were confirmed to be present over the entire region, and the bubble reduction effect such as demonstrated in Examples 1 to 4 could not be confirmed.

Therefore, in Example 1 using the continuous casting method of Embodiment 1, the N pickup in the casting process can be suppressed to about the same level as in Comparative Example 1, in which nitrogen gas was not used as the seal gas, while suppressing the bubble defects in the slab almost to zero. Therefore, the continuous casting method of Embodiment 1 can be effectively used instead of the conventional casting method using argon gas as the seal gas for the production of stainless steel with a low nitrogen content in which the content of nitrogen component is 400 ppm or less.

Further, in Examples 2 to 4 using the continuous casting method of Embodiment 2, while suppressing the bubble defects in the slab almost to zero, the N pickup in the casting process can be suppressed to below that in Comparative Example 1, in which nitrogen gas was not used as the seal gas, and can effectively be zero. Therefore, the continuous casting method of Embodiment 2 can be effectively used for the production of stainless steels of a low-nitrogen steel grade and this method demonstrates an effect of reducing the bubble defects.

Therefore, by using nitrogen gas as the seal gas in the stationary state of casting, it is possible to suppress the occurrence of bubbles in the cast stainless steel billet. Further, by using the long nozzle 2 immersed by the spout 2*a* thereof into the molten stainless steel in the tundish 101 in the stationary state of casting, it is possible to reduce the N pickup. In addition, by covering the surface of the molten stainless steel in the tundish 101 with TD powder in the stationary state of casting, it is possible to reduce the N pickup close to 0.

In addition to the abovementioned steel grades, the present invention was also applied to SUS409L, SUS444, SUS445J1, and SUS304L, and the possibility of obtaining the N pickup reduction effect and bubble reduction effect such as demonstrated in Examples 1 to 4 was confirmed.

Further, the continuous casting methods according to Embodiments 1 and 2 were applied to the production of stainless steel, but they may be also applied to the production of other metals.

The control in the tundish 101 in the continuous casting methods according to Embodiments 1 and 2 is applied to continuous casting, but it may be also applied to other casting methods.

REFERENCE SYMBOLS

1 ladle, 2 long nozzle, 2*a* spout, 3 molten stainless steel (molten metal), 3*c* stainless steel billet (solid metal), 4 nitrogen gas, 5 tundish powder, 100 continuous casting device, 101 tundish, 105 casting mold.

The invention claimed is:

1. A continuous casting method for casting a solid metal by pouring a molten metal in a ladle into a tundish disposed therebelow and continuously pouring the molten metal in the tundish into a casting mold, the continuous casting method comprising:

supplying a nitrogen gas as a seal gas around the molten metal in the tundish;

pouring into the tundish the molten metal in the ladle through a pouring nozzle so that the molten metal in the tundish immerses a spout of the pouring nozzle, which serves for pouring into the tundish the molten metal in the ladle; and pouring into the casting mold the molten metal in the tundish, while the spout of the pouring nozzle is immersed by the molten metal in the tundish;

wherein a tundish powder is sprayed over a surface of the molten metal in the tundish after the step of supplying the nitrogen gas and before the step of pouring into the casting mold the molten metal in the tundish, and the tundish powder is interposed between the molten metal and the nitrogen gas, and wherein the tundish powder comprises a synthetic slag agent which absorbs the nitrogen component contained in the molten metal.

2. The continuous casting method of claim 1, wherein the spout of the pouring nozzle is inserted to a depth of 100 mm to 150 mm into the molten metal in the tundish.

3. The continuous casting method of claim 2, wherein the solid metal which is to be cast is a stainless steel with a concentration of contained nitrogen of 400 ppm or less.

4. The continuous casting method of claim 1, wherein the solid metal which is to be cast is a stainless steel with a concentration of contained nitrogen of 400 ppm or less.

5. The continuous casting method of claim 1 further comprising adjusting the flow rate of the molten metal pouring into the tundish and the flow rate of the molten metal pouring into the casting mold so that a surface of the molten metal in the tundish is maintained at a predetermined depth in an interior of the tundish, wherein the spout of the pouring nozzle remains immersed by the molten metal in the tundish.

* * * * *